US010957497B2

(12) United States Patent
Drechsler et al.

(10) Patent No.: US 10,957,497 B2
(45) Date of Patent: Mar. 23, 2021

(54) ENCLOSURES HAVING SLOPING AND CONVEX CURVED TOPS

(71) Applicant: HUBBELL INCORPORATED, Shelton, CT (US)

(72) Inventors: Dale Alan Drechsler, Westbrook, CT (US); Gregory Bryant McAleer, Fairfield, CT (US); Bart Richard Hogestyn, Oxford, CT (US); Thomas Louis Scanzillo, Monroe, CT (US)

(73) Assignee: HUBBELL INCORPORATED, Shelton, CT (US)

( * ) Notice: Subject to any disclaimer, the term of this patent is extended or adjusted under 35 U.S.C. 154(b) by 258 days.

(21) Appl. No.: 15/184,431

(22) Filed: Jun. 16, 2016

(65) Prior Publication Data

US 2016/0368655 A1 Dec. 22, 2016

Related U.S. Application Data

(60) Provisional application No. 62/181,966, filed on Jun. 19, 2015.

(51) Int. Cl.

| | |
|---|---|
| ***H01H 9/04*** | (2006.01) |
| ***B65D 8/00*** | (2006.01) |
| ***B65D 6/00*** | (2006.01) |
| ***H01H 9/28*** | (2006.01) |
| ***H01H 19/06*** | (2006.01) |

(52) U.S. Cl.

CPC ..... *H01H 9/04* (2013.01); *B65D 7/04* (2013.01); *B65D 7/12* (2013.01); *H01H 9/281* (2013.01); *H01H 19/06* (2013.01)

(58) Field of Classification Search

CPC . H10H 9/04; H10H 9/281; H10H 9/06; B65D 7/04; B65D 25/20; B65D 7/12; B60N 3/105

USPC ..... 220/476

See application file for complete search history.

(56) References Cited

U.S. PATENT DOCUMENTS

| | | | |
|---|---|---|---|
| D2,329 | S | 5/1894 | Vleck |
| 791,068 | A | 5/1905 | Baker |
| 1,872,323 | A | 8/1932 | Nichols |
| 3,402,846 | A | 9/1968 | Zerwes |
| 3,439,108 | A | 4/1969 | Zerwes |
| 3,686,425 | A | 8/1972 | Zerwes |
| 4,896,784 | A | 1/1990 | Heath |

(Continued)

FOREIGN PATENT DOCUMENTS

| | | | |
|---|---|---|---|
| DE | 202013004440 | U1 | 6/2014 |
| GB | 2463473 | A | 3/2010 |
| GB | 2515016 | A | 12/2014 |

OTHER PUBLICATIONS

International Search Report dated Sep. 13, 2016 from corresponding PCT Application No. PCT/US16/37854, 3 pages.

(Continued)

*Primary Examiner* — James N Smalley
*Assistant Examiner* — Jennifer Castriotta
(74) *Attorney, Agent, or Firm* — Ohlandt, Greeley, Ruggiero & Perle, L.L.P.

(57) ABSTRACT

An enclosure is provided that includes a main housing, a top housing, and a front housing. The main housing defines at least a rear wall of the enclosure, the top housing defines a top wall and a pair of side walls of the enclosure, and the front housing defines a front wall of the enclosure. The top wall has a convex curved portion that spans between side walls, where the convex curved portion has an angle that slopes downward from the rear wall towards the front wall.

16 Claims, 7 Drawing Sheets

(56) References Cited

U.S. PATENT DOCUMENTS

| | | | |
|---|---|---|---|
| D354,738 | S | 1/1995 | Zimmermann |
| 5,456,377 | A | 10/1995 | Williams |
| D370,890 | S | 6/1996 | Tiberio |
| 5,533,637 | A | 7/1996 | Williams |
| 5,664,955 | A | 9/1997 | Arnett |
| 5,914,460 | A | 6/1999 | Mowery et al. |
| 6,118,074 | A | 9/2000 | Turcovsky |
| D577,280 | S | 9/2008 | Parker |
| D577,987 | S | 10/2008 | Corbin |
| 7,527,190 | B1 | 5/2009 | Bowers et al. |
| 7,834,267 | B1 | 11/2010 | Gretz |
| 7,897,870 | B1 | 3/2011 | Gretz |
| 2007/0126320 | A1 | 6/2007 | Huang |
| 2009/0031643 | A1 | 2/2009 | Allen |
| 2010/0147547 | A1 | 6/2010 | Drane |
| 2011/0068103 | A1 | 3/2011 | Provenzano |
| 2015/0076978 | A1 | 3/2015 | Ellingson |

OTHER PUBLICATIONS

Written Opinion dated Sep. 13, 2016 from corresponding PCT Application No. PCT/US16/37854, 9 pages.

Product Datasheet, "HBLDS3—Switched Enclosure"; UPC No. 783585955001, Oct. 1, 2014, http://www.hubbellcatalog.com/wiring/section-c-datasheet.asp?FAM=Switches&PN=HBL.

Spec Grade Stainless Blank Enclosure; "Sloped-Top Stainless Enclosure", Mennekes Electronics, Inc., 2014.

Disconnect Enclosures from Hubbell dated Dec. 22, 2014.

Extended European Search Report dated Jan. 25, 2019 in corresponding European Patent Application No. EP16812429.5, 8 pages.

Extended European Search Report dated Jan. 27, 2020 in corresponding European Patent Application No. EP16812429.5.

Hubbell Circuit Lock, URL:http://ecatalog.hubbell-wiring.com/press/pdf/Original_WLFSD006.pdf, dated Dec. 28, 2015 (D5 of the EP search report).

Circuit Lock 60 & 100 AMPS sloped top disconnect switch, URL:http://assets.unilogcorp.com/2/item/doc/wiring_device_kellems_HBLDS10SSR_technical_Drawing.pdf, dated Oct. 21, 2014 (D6 of the EP search report).

Disconnect enclosures from Hubbell engineered to shed water and debris—Graybar Industrial, URL:http://www.graybarindustrial/com/disconnect-enclosures, dated Dec. 22, 2014 (D7 of the EP search report).

ENCLOSURES HAVING SLOPING AND CONVEX CURVED TOPS

CROSS REFERENCE TO RELATED APPLICATIONS

This application claims the benefit of U.S. Provisional Application Ser. No. 62/181,966 filed on Jun. 19, 2015, the contents of which are incorporated herein by reference.

BACKGROUND

1. Field of the Invention

The present disclosure is related to enclosures. More particularly, the present disclosure is related to enclosures having sloping and convex curved tops.

2. Description of Related Art

Enclosures for protecting and/or mounting sensitive or fragile devices such as electrical devices, communication devices, pneumatic devices, and other devices are known. In many instances, the enclosures are used in environments where cleanliness is of primary importance—meaning that the enclosure is exposed to frequent cleaning activities that include water and/or other cleaning agents.

Thus, it has been determined by the present disclosure that there is a continuing need for enclosures that provide for protection and/or mounting of sensitive or fragile devices in demanding environments.

Accordingly, it has been determined by the present disclosure that there is a continuing need for enclosures that overcome, alleviate, and/or mitigate one or more of the aforementioned and other deleterious effects of prior art enclosures.

SUMMARY

An enclosure is provided that includes a main housing, a top housing, and a front housing. The main housing defines at least a rear wall of the enclosure, the top housing defines a top wall and a pair of side walls of the enclosure, and the front housing defines a front wall of the enclosure. The top wall has a convex curved portion that spans between side walls, where the convex curved portion has an angle that slopes downward from the rear wall towards the front wall.

In embodiments alone or in combination with one or more of the aft mentioned embodiments, the top and side walls of the top housing further include an overhang, which extends forward of the front wall.

In embodiments alone or in combination with one or more of the aft mentioned embodiments, the rear wall further includes one or more main mounts, which are configured to secure the enclosure to a support structure with a standoff between the rear wall and the support structure.

In embodiments alone or in combination with one or more of the aft mentioned embodiments, the one or more main mounts each have a downwardly sloping shoulder that acts as a guide channel to prevent the collection of water or debris.

In embodiments alone or in combination with one or more of the aft mentioned embodiments, the downwardly sloping shoulder slopes toward an outer edge of the rear wall.

In embodiments alone or in combination with one or more of the aft mentioned embodiments, the one or more main mounts are stamped in the rear wall.

In embodiments alone or in combination with one or more of the aft mentioned embodiments, the main housing further includes one or more supplemental mounts, which are configured to assist the one or more main mounts in securing the enclosure to the support structure with the standoff between the rear wall and the support structure.

In embodiments alone or in combination with one or more of the aft mentioned embodiments, the one or more supplemental mounts further includes a shoulder that slopes at least away from the rear wall.

The above-described and other features and advantages of the present disclosure will be appreciated and understood by those skilled in the art from the following detailed description, drawings, and appended claims.

DETAILED DESCRIPTION

Figure 1:
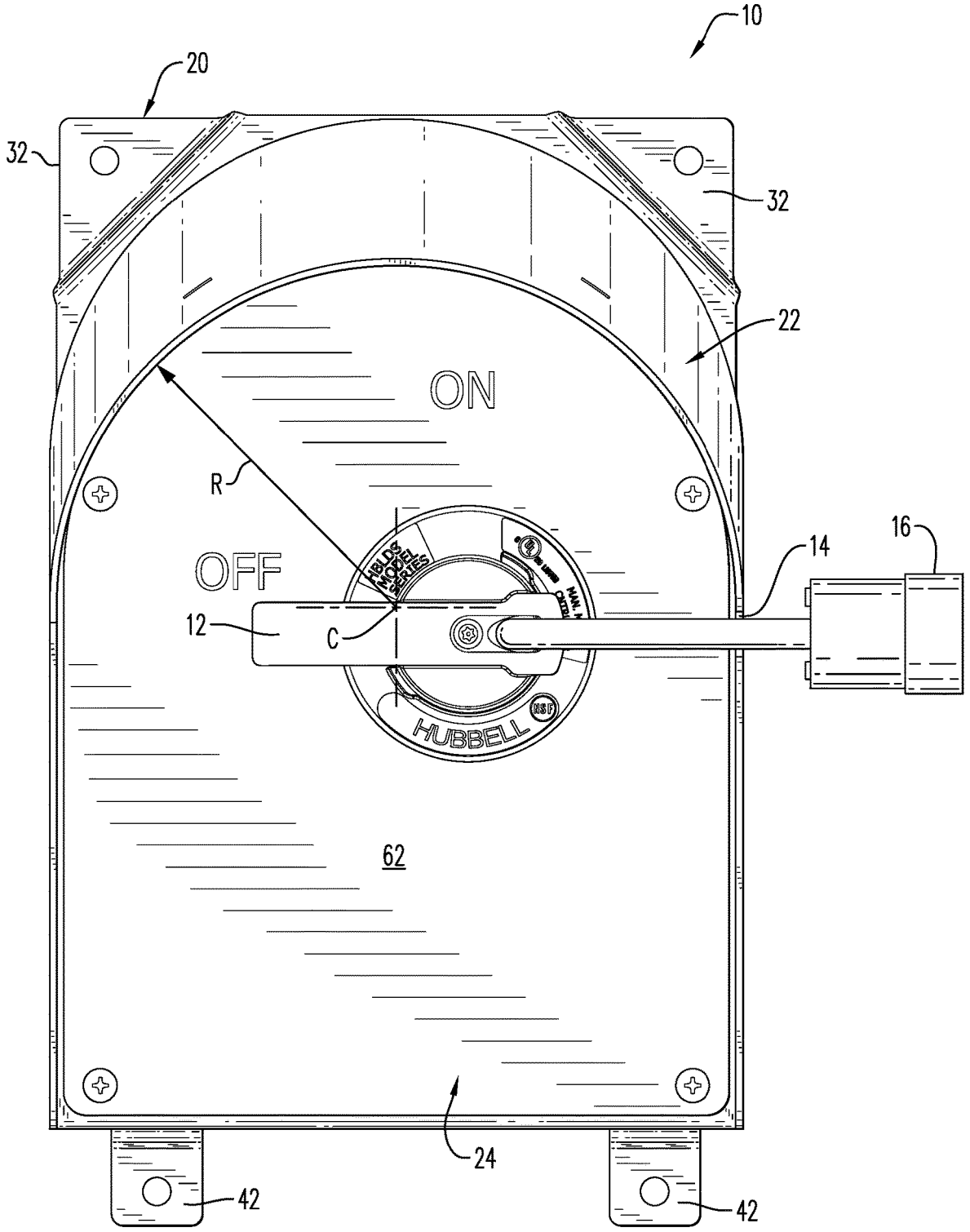
FIG. 1 is a front view of an exemplary embodiment of an enclosure according to the present disclosure, shown in a locked state.
Figure 2:
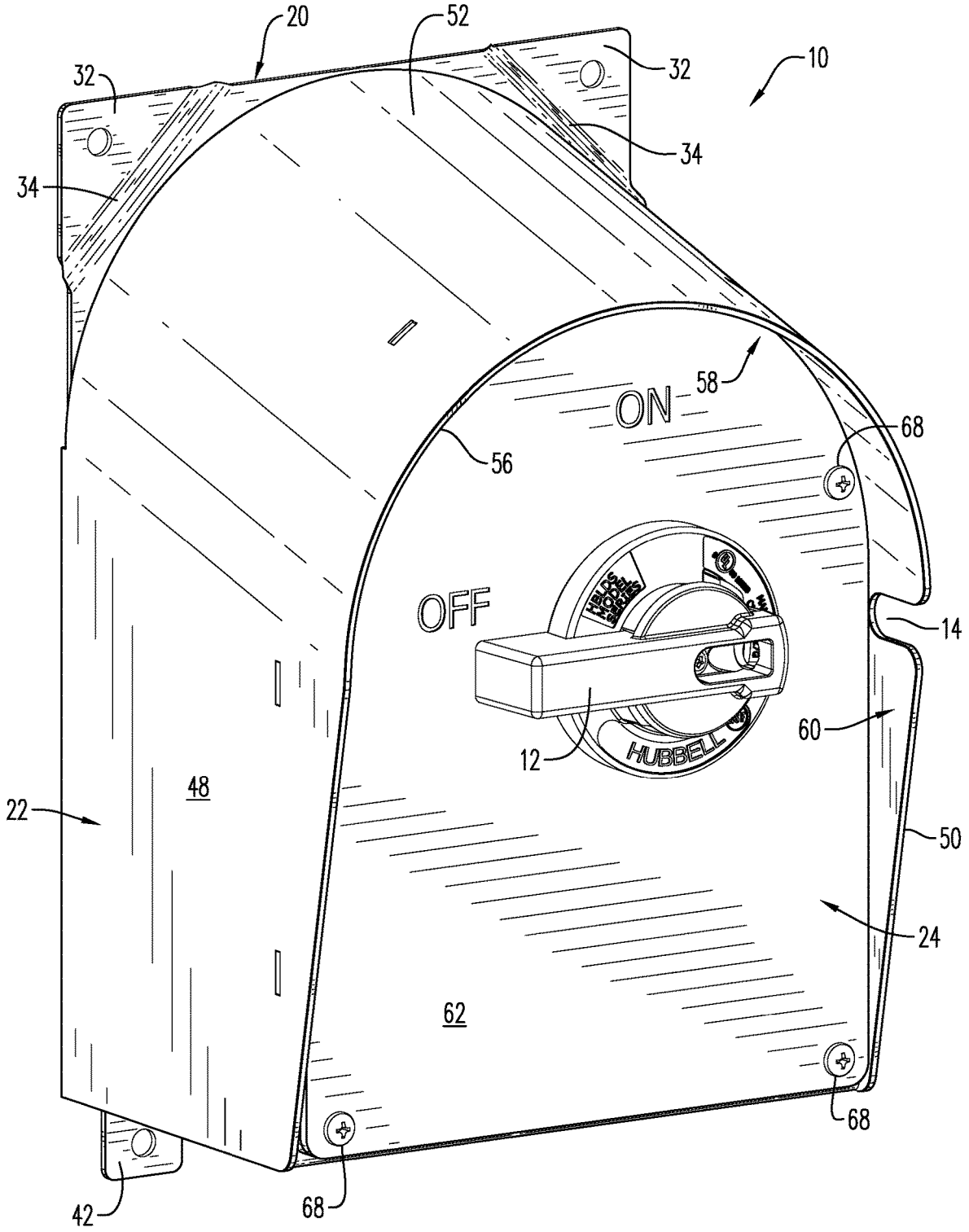
FIG. 2 is a front, top perspective view of the enclosure of FIG. 1, shown in an unlocked state.
Figure 3:
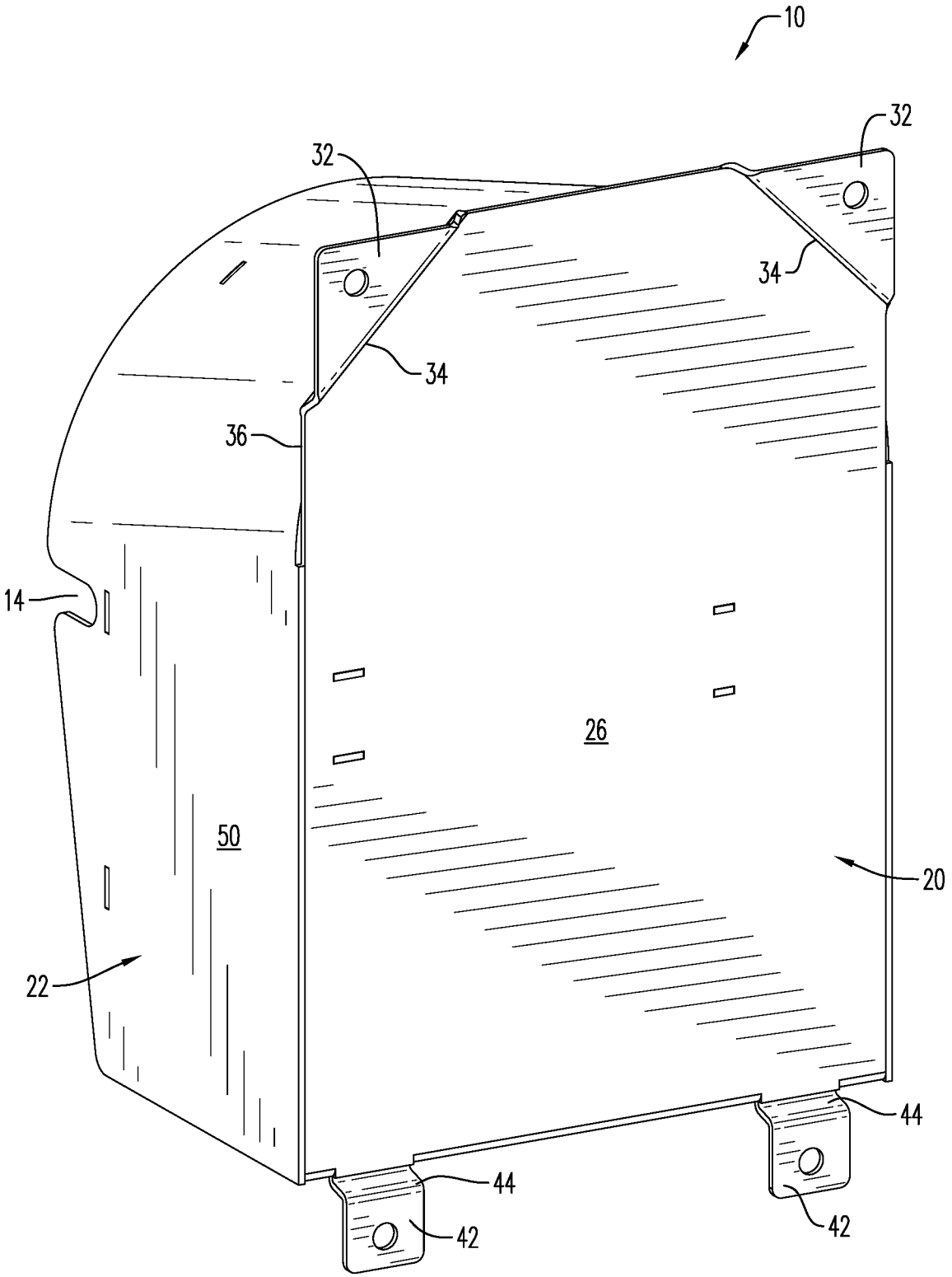
FIG. 3 is a rear, top perspective view of the enclosure of FIG. 2.
Figure 4:
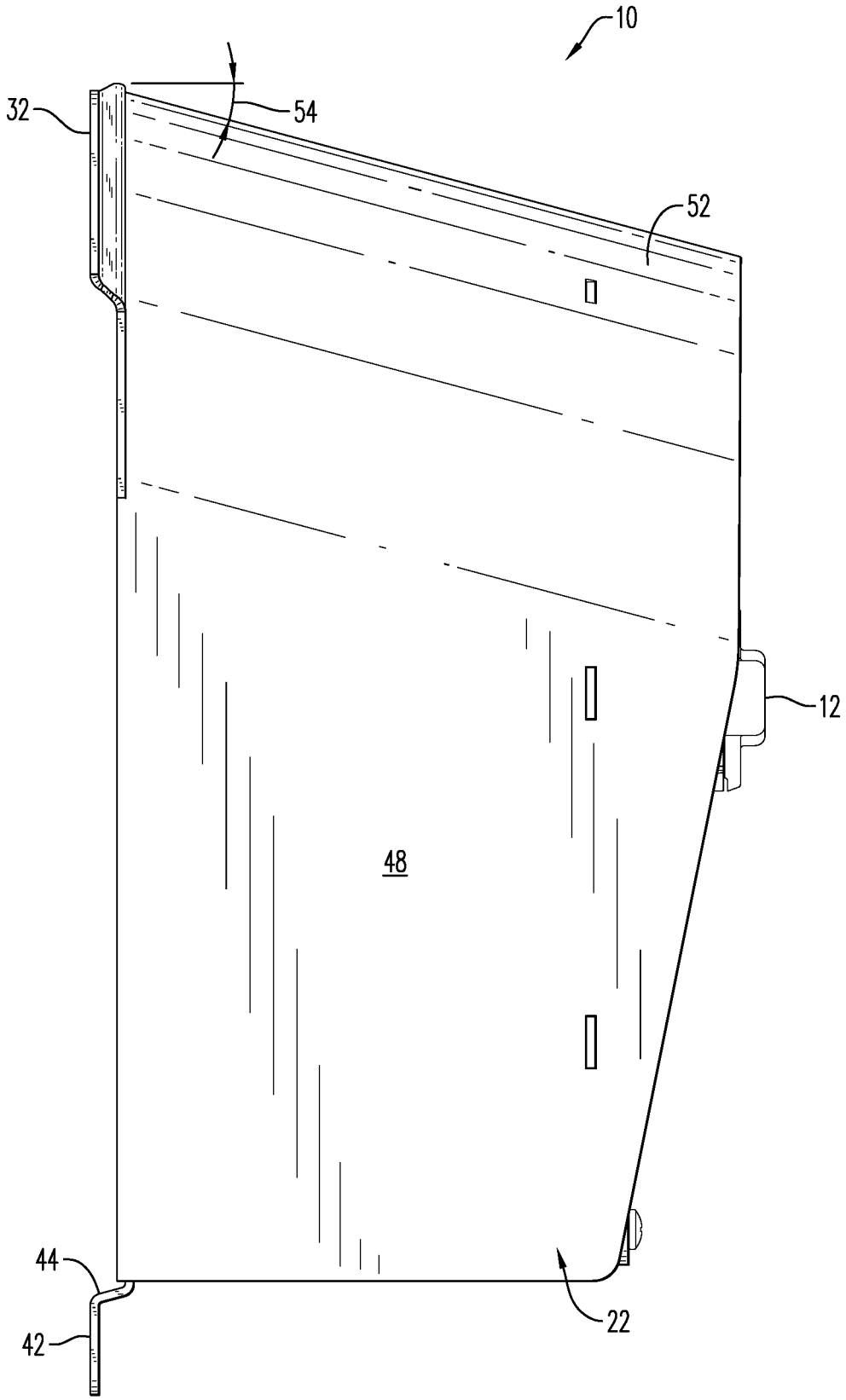
FIG. 4 is a side view of the enclosure of FIG. 2.
Figure 5:
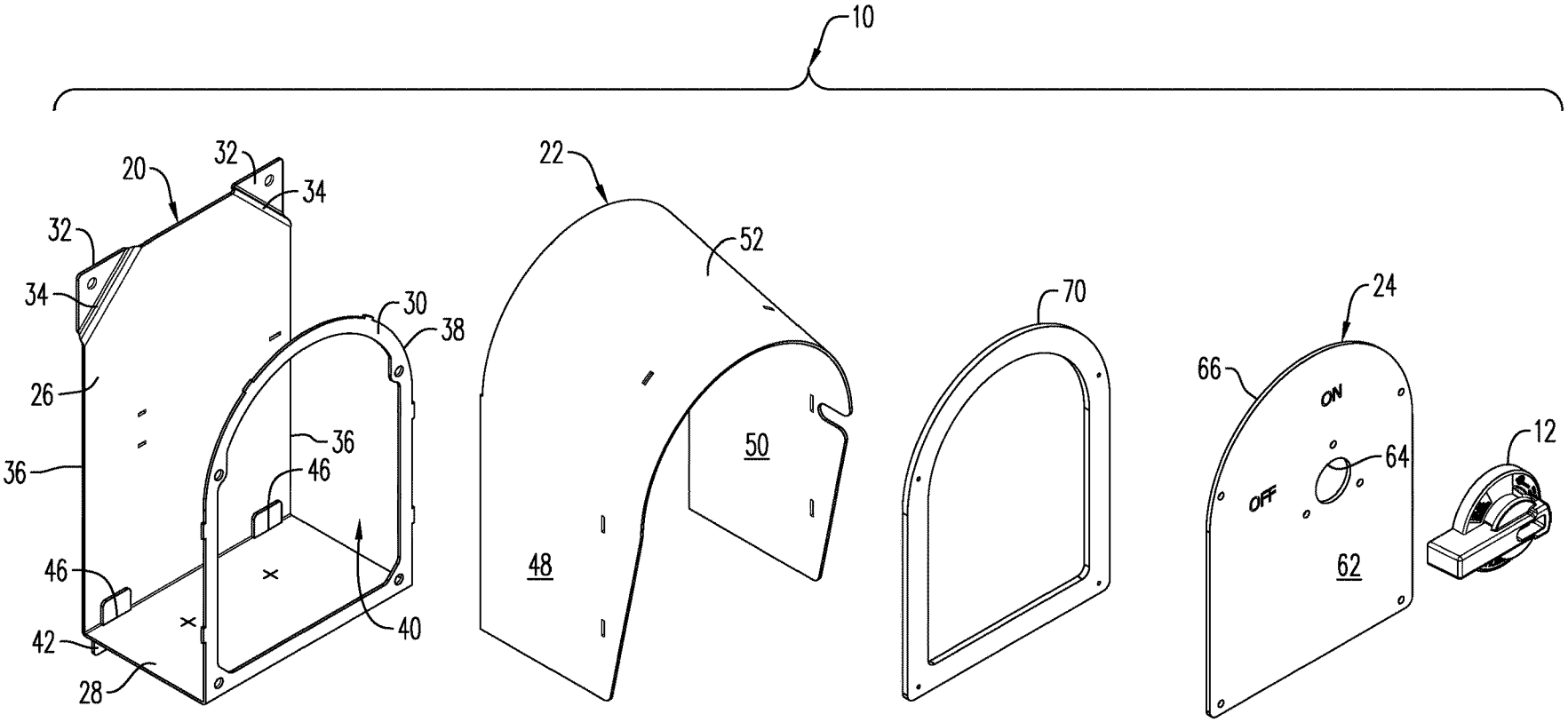
FIG. 5 is an exploded view of the enclosure of FIG. 2.
Figure 6:
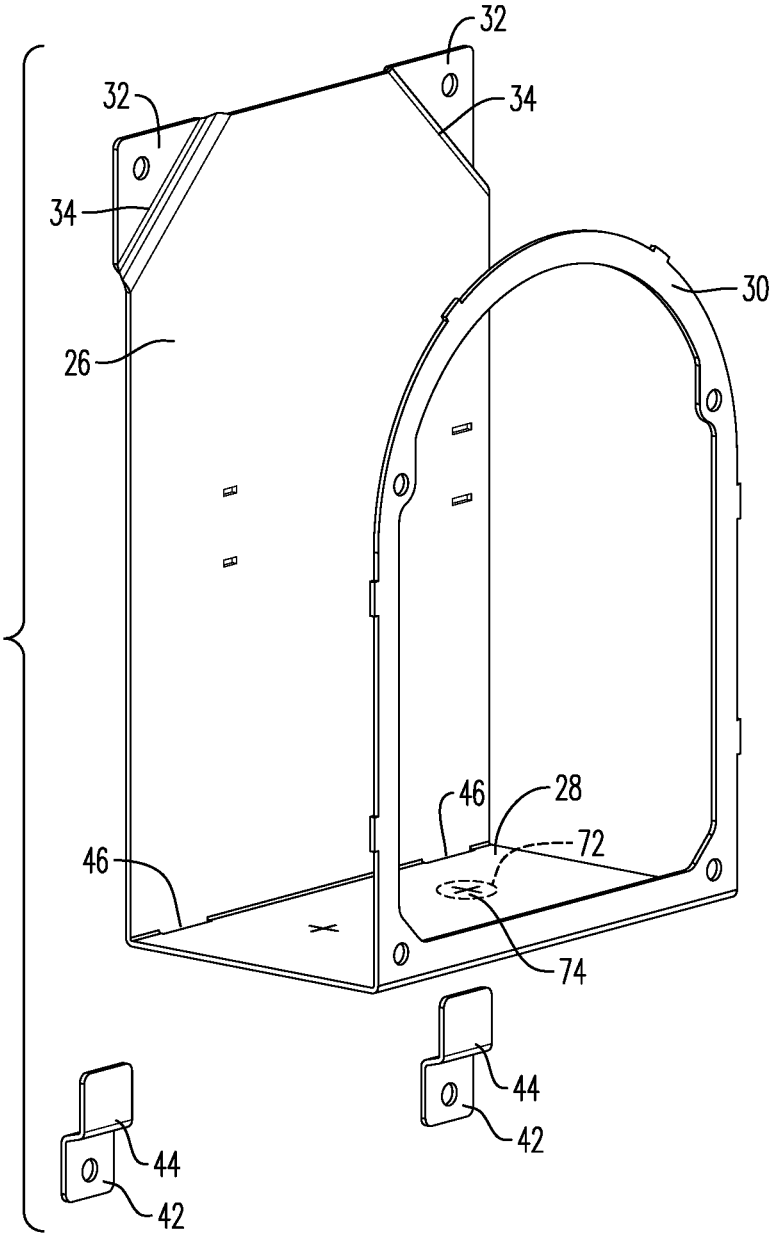
FIG. 6 is an exploded view of the main housing of FIG. 5.

Referring to the drawings and in particular to FIGS. 1-3, an exemplary embodiment of an enclosure according to the present disclosure is shown and is generally referred to by reference numeral 10. Enclosure 10 is configured to protect and mount one or more devices 12, illustrated by way of example as a rotary switch, to a support structure (i.e., wall, machine, etc.).

Advantageously, enclosure 10 is configured for use in environments where sanitary conditions are maintained through routine wash and/or hose downs such as commercial kitchens, restaurants, food manufacturing facilities, medical device manufacturing facilities, semiconductor manufacturing facilities, drug or chemical manufacturing facilities, and others. Thus, device 10 to shield device 12 from contact with the operator, debris, and, in some instances, liquid such as water—while providing easily to clean surfaces and surfaces that shed water and debris, allows cleaning of the space behind the enclosure, and prevent spaces that allow the growth and/or harboring of contaminants such as, but not limited to, bacteria, viruses, mold, and others.

Generally and as is described in more detail below, enclosure 10 has a downward sloping and convex curved top that prevents or at least mitigates any standing liquids or other matter that can accumulate and lead to grow and/or harboring of contaminants.

Accordingly, in some embodiments either alone or in combination with one or more of the aft mentioned standards, enclosure 10 is configured to be suitable for protection from at least light splashes of liquid, namely to be rated Type 2 by the National Electrical Manufacturing Association (NEMA). Of course, it is contemplated by the present disclosure for enclosure 10 to be configured for protection from splashes (e.g., NEMA—Type 4 and/or 4X), from temporary submersion (e.g., NEMA—Type 6), from permanent submersion (e.g., NEMA—Type 6P), from oil seepage (e.g., NEMA—Type 12 and/or 12K), from oil splashes (e.g., NEMA—Type 13), and any combinations thereof.

In other embodiments either alone or in combination with one or more of the afore and/or aft mentioned standards, enclosure 10 is configured to meet or exceed the requirements under the International Protection Marking code (IP Code) for at least solid and liquid ingress protection. In one particularly embodiment, enclosure 10 has an IP Code rating of IP69k. Of course, it is contemplated for enclosure 10 to have any desired level of protection under the IP Code against ingress of solid objects and/or liquids.

For example, it is contemplated by the present disclosure for enclosure 10 to be sufficient to have a level of protection under the IP Code for solid objects (indicated by the first digit in the IP Code) including, but not limited to, Level 1, which protects against ingress of objects having a size of greater than 50 mm; Level 2, which protects against ingress of objects having a size of greater than 12.5 mm; Level 3, which protects against ingress of objects having a size of greater than 2.5 mm; Level 4, which protects against ingress of objects having a size of greater than 1 mm; Level 5, which protects against ingress of dust protected; or Level 6, which is dust tight.

Further, it is contemplated by the present disclosure for enclosure 10 to be sufficient to have a level of protection under the IP Code for liquids (indicated by the second digit in the IP Code) including, but not limited to, Level 1, which protects against dripping water; Level 2, which protects against ingress of Dripping water when tilted up to 15°; Level 3, which protects against ingress of Spraying water; Level 4, which protects against ingress of Splashing of water; Level 5, which protects against ingress of Water jets; Level 6, which protects against ingress of Powerful water jets; Level 6K, which protects against ingress of Powerful water jets with increased pressure; Level 7, which protects against immersion in water up to 1 m; Level 8, which protects against immersion in water beyond 1; and Level 9K, which protects against ingress of powerful high temperature water jets.

In other embodiments either alone or in combination with one or more of the afore and/or aft mentioned standards, enclosure 10 is configured to meet or exceed the requirements under the National Sanitation Foundation (NSF) Standard 51 for Food Equipment Materials.

Additionally, enclosure 10—when used with an electrical control device such as a switch—is further configured to meet lock out requirements such as those required by the Occupational Safety and Health Administration (OSHA). Specifically, enclosure 10 includes a locking feature 14, which allows the user to secure device 12 in a desired position (e.g., de-energized) with a lock 16 or other device.

Enclosure 10 is described in more detail with simultaneous reference to FIGS. 2-6. Enclosure 10 has a main housing 20, a top housing 22, and a front housing 24.

Main housing 20 defines a rear wall 26, a bottom wall 28, and a front mount region 30. Rear wall 26 includes one or more main mounts 32, which are configured to secure enclosure 10 to a support structure (not shown) with a desired gap or standoff between the rear wall and the support structure. Additionally, main mounts 32 include downwardly sloping shoulder 34 that acts as a guide channel to prevent the collection of water or debris on enclosure 10. In the illustrated embodiment, shoulder 34 slopes toward an outer edge 36 of rear wall 26, so as to prevent the water or debris from being guided between the rear wall and the support structure. Of course, it is contemplated by the present disclosure for shoulder 34 to slope away from outer edge 36 or in one or more desired directions.

In the illustrated embodiment, main housing 20 is formed as a single member of a stamped metal. Of course, other configurations of main housing 20 are contemplated by the present disclosure.

Main housing 20 can also include one or more supplemental mounts 42, which are configured to assist main mounts 32 in securing enclosure 10 to the support structure with the desired gap or standoff between rear wall 26 and the support structure. Supplemental mounts 42, similar to main mounts 32 discussed above, includes a shoulder 44 that acts as a guide channel to prevent the collection of water or debris on enclosure 10. In the illustrated embodiment, shoulder 44 slopes toward the support structure and away from rear wall 26. Of course, it is contemplated by the present disclosure for shoulder 44 to slope any desired direction—or in more than one direction—such as, but not limited to away from outer edge 36.

In the illustrated embodiment, supplemental mounts 42 are positioned in an opening 46 defined in main housing 20—namely in rear wall 26 and/or bottom wall 28. Here, the mounts 42 can be secured to main housing 20 preferably by a weld or braze that also functions to seal opening 46.

Top housing 22 defines side walls 48, 50 and a top wall 52. Top housing 22 and main housing 20 are secured to one another in any desired method. Preferably, main and top housings 20, 22 are secured to one another by a weld or weld or braze that also functions to seal any gaps therebetween.

Advantageously, top wall 52 has an angle 54 that slopes downward from rear wall 28 towards front housing 24. Downward angle 54 is preferably less than 45 degrees, more preferably less than 30 degrees, with about 15 degrees being most preferred, and any subranges therebetween.

Furthermore, top wall 52 further includes a convex curved portion 56 that spans the area between side walls 48, 50. Curved portion 56 is preferably semi-circular with a center of curvature (C) and a radius (R).

Thus, top housing 22 has downward angle 54 in one plane, namely the plane extending from rear wall 26 to front housing 24, and has curved portion 56 in a second plane, namely the plane extending between side walls 48, 50. Simply stated, convex curved portion 56 is both curved and downwardly angled.

In this manner, enclosure 10 advantageously ensures that any liquid that is sprayed onto top housing 22 is guided away from the intersection of rear housing 20 and top housing 22 by angle 54 and off of the top housing by curved portion 56. Additionally, enclosure 10 also advantageously prevents or mitigates instances of the enclosure being used as step or shelf, which can damage the enclosure and/or device 12 therein.

Further, top housing 22 is configured so that at least top wall 52 forms an overhang or shield 58. Preferably, top housing 22 is also configured so that side walls 48, 50 also form overhang or shield 60.

Advantageously, overhangs 58, 60 extend forward of front housing and at least a portion of electrical 12. In this manner, fluid falling off of curved portion 56 as a result of angle 54 does not land on device 12. Moreover, overhangs 58, 60 allow enclosure 10 to be sufficient, in some embodiments, to provide protection to device 12 and/or to front housing 24 against incidental impacts. Here, it is contemplated by the present disclosure for enclosure 10 to find use in industrial settings, where motorized traffic and/or the transportation of materials or goods is common such that the enclosure provides a level of protection against inadvertent impact by these and/or other traffic.

In the illustrated embodiment, top housing 22 is formed as a single member of a stamped metal. Of course, other configurations of top housing 22 are contemplated by the present disclosure.

Front housing 24 defines a front wall 62 having an opening 64 through which device 12 is accessed and/or protrudes. In some embodiments, enclosure 10 can include a gasket or other seal (not shown) to seal any gap between device 12 and front wall 62 and/or opening 64.

Advantageously, front wall 62 has a curved portion 66 that corresponds to curved portion 56 so as to close any gap between top and front housings 22, 24. Front wall 62 is removably secured to front mount region 30 of main housing 20 by one or more mechanical fasteners 68. In some embodiments, enclosure 10 can include a gasket or other seal 70 to seal any gap between front wall 62 and/or front mount region 30 and/or top housing 22. Thus, front mount region 30 has an outer rim 38 that matches curved portions 56 66 and includes an open region 40 within the outer rim.

In the illustrated embodiment, front housing 24 is formed as a single member of a stamped metal. Of course, other configurations of front housing 24 are contemplated by the present disclosure.

Main, top, and front housings 20, 22, and 24 of enclosure 10 are described above as being made of stamped metal. Of course, it is contemplated by the present disclosure for each of the housings 20, 22, 24 to be made of any similar or dissimilar material that has the strength and clean ability sufficient to meet the requirements discussed above. In one particular embodiment, housings 20, 22, and 24—as well as supplemental mounts 42—are made of stamped stainless steel and/or cold rolled steel having a protective and/or corrosion resistant coating.

In embodiments, were the device 12 requires a feed line (i.e., power line, communication cable, pneumatic conduit, etc.), enclosure 10 can include an opening through one or more walls of the housing 20, 22, and 24 and a water tight insert (not shown) positioned in the opening in a manner known in the art. Preferably, enclosure 10 includes an opening 70—in some embodiment temporarily closed by a knockout 72—through bottom wall 28.

Figure 7:
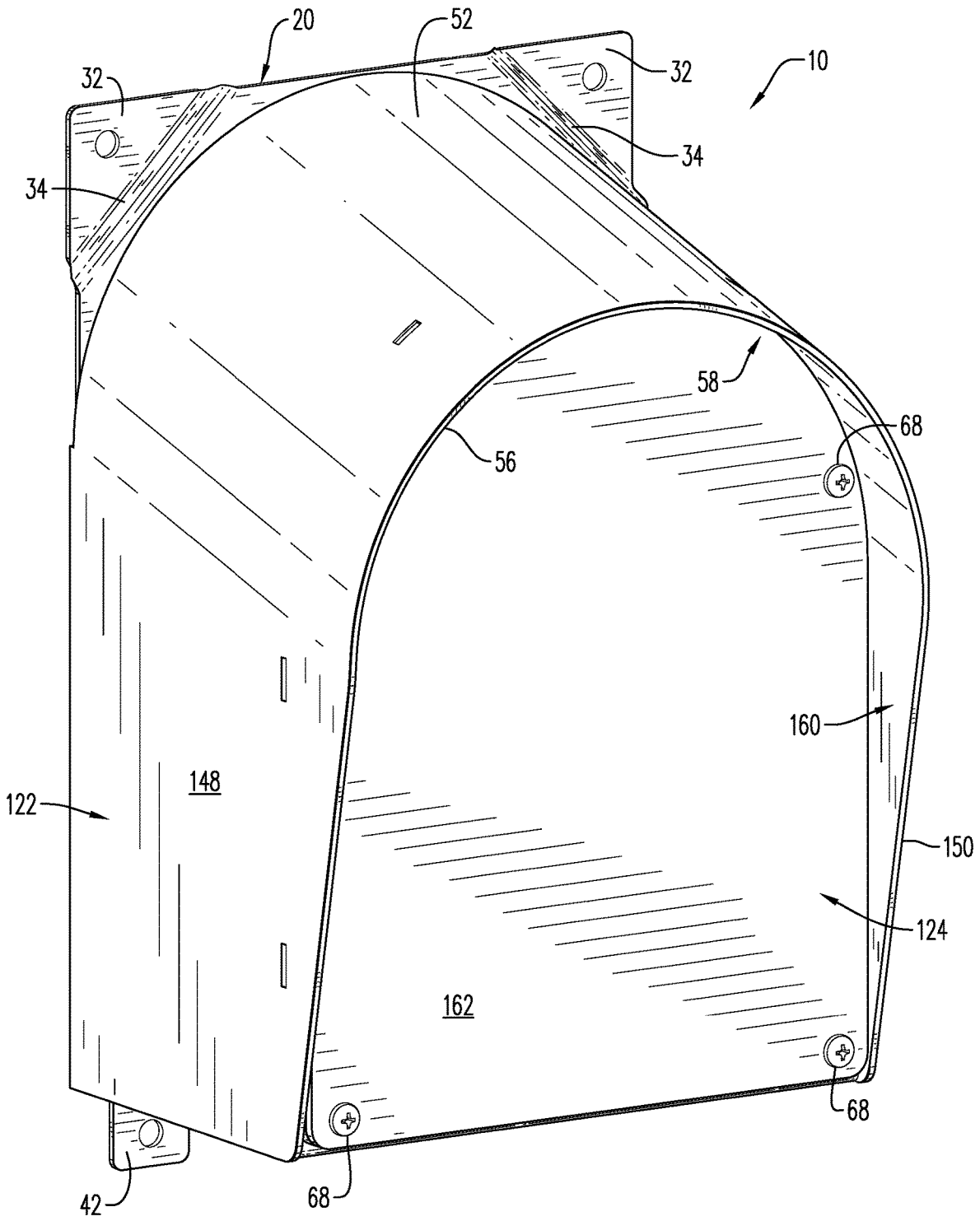
FIG. 7 is a front, top perspective view of the enclosure of FIG. 1, shown with alternate exemplary embodiments of a front housing and a side housing.

It should be recognized that enclosure 10 is illustrated having device 12 as a rotary switch and extending outwardly from front housing 24. Of course, it is contemplated by the present disclosure for device 12 to be any desired device that protrudes from front housing 24 or is housed completely within enclosure 10. In some embodiments, device 12 can be a device selected from the group consisting of an electrical device, a communication device, a pneumatic device, and other devices For example, enclosure 10 is shown in FIG. 7 having an alternate exemplary embodiment of a top housing 122 and a front housing 124.

Here, front housing 124 defines a front wall 162—that lacks the opening 64 of the embodiment of enclosure 10 shown in FIGS. 1-6. Rather, a device (not shown) is housed within enclosure 10. In this embodiments where front housing 124 lacks a device extending therefrom, top housing 122 can also lack the locking feature 14 shown in FIGS. 1-6. Rather in this embodiment, top housing 122 can includes side walls 148, 150 that provide overhang or shield 160 without the locking feature.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

| REFERENCE NUMBERS: | |
|---|---|
| enclosure | 10 |
| device | 12 |
| locking feature | 14 |
| lock | 16 |
| — | 18 |
| main housing | 20 |
| top housing | 22 |
| front housing | 24 |
| rear wall | 26 |
| bottom wall | 28 |
| front mount region | 30 |
| main mounts | 32 |
| shoulder | 34 |
| outer edge | 36 |
| outer rim | 38 |
| open region | 40 |
| supplemental mounts | 42 |
| shoulder | 44 |
| opening | 46 |
| side walls | 48, 50 |
| top wall | 52 |
| angle | 54 |
| convex curved portion | 56 |
| overhangs | 58, 60 |
| center of curvature | C |
| radius | R |
| front wall | 62 |
| opening | 64 |
| curved portion | 66 |
| fastener | 68 |
| gasket or seal | 70 |
| opening | 72 |
| knockout | 74 |
| top housing | 122 |
| front housing | 124 |
| side walls | 148, 150 |
| overhang | 160 |
| front wall | 162 |

What is claimed is:

1. An enclosure comprising:

a main housing that defines at least a rear wall of the enclosure;

a top housing that defines a top wall and a pair of side walls of the enclosure;

a front housing that defines only a front wall of the enclosure, the top wall having a convex curved portion that spans between the side walls, wherein the convex curved portion has an angle that slopes downward from the rear wall towards the front wall; and one or more main mounts configured to secure the rear wall to a support structure with a standoff between the rear wall and the support structure, wherein the one or more main mounts each have a downwardly sloping shoulder that acts as a guide channel to prevent the collection of water or debris, and wherein the downwardly sloping shoulder slopes from a point more centrally located along a top edge of the rear wall outward toward an outer lateral edge of the rear wall.

2. The enclosure of claim 1, wherein the top and side walls of the top housing further comprise an overhang, which extends forward of the front wall.

3. The enclosure of claim 1, wherein the one or more main mounts are stamped in the rear wall.

4. The enclosure of claim 1, wherein the main housing further comprises one or more supplemental mounts, which are configured to assist the one or more main mounts in securing the enclosure to the support structure with the standoff between the rear wall and the support structure.

5. The enclosure of claim 4, wherein the one or more supplemental mounts further comprise a shoulder that slopes at least away from the rear wall.

6. The enclosure of claim 1, wherein the front wall has an opening sufficient to receive a portion of a device therethrough.

7. An enclosure comprising:

a top housing that defines a top wall and a pair of side walls of the enclosure, the top wall having a convex curved portion that spans between the side walls;

a front housing that defines a front wall, the front wall having a curved portion that corresponds to the curved portion of the top wall so as to close any gap between the top and front housings;

a main housing that defines a rear wall, a bottom wall, and a front mount region, the front mount region having an outer rim that matches the curved portions of the top and front housings, wherein the convex curved portion has an angle that slopes downward from the rear wall towards the front wall; and a main mount configured to secure the rear wall to a support structure with a standoff between the rear wall and the support structure, wherein the main mount has a downwardly sloping shoulder that slopes from a point more centrally located along a top edge of the rear wall outward toward an outer lateral edge of the rear wall.

8. The enclosure of claim 7, wherein the top and side walls of the top housing further comprise an overhang, which extends forward of the front wall.

9. The enclosure of claim 7, wherein the one or more main mounts are stamped in the rear wall.

10. The enclosure of claim 7, wherein the main housing further comprises one or more supplemental mounts, which are configured to assist the one or more main mounts in securing the enclosure to the support structure with the standoff between the rear wall and the support structure.

11. The enclosure of claim 10, wherein the one or more supplemental mounts further comprise a shoulder that slopes at least away from the rear wall.

12. The enclosure of claim 7, wherein the front wall is removably connected to the front mount region.

13. The enclosure of claim 12, further comprising a gasket between the front wall and the front mount region.

14. The enclosure of claim 7, wherein the front wall and the front mount region further includes open regions sufficient to receive a portion of a device therethrough.

15. An enclosure comprising:

a main housing that defines a rear wall, a bottom wall, and a front mount region;

a front housing that defines a front wall, the front housing being removably secured to the front mount region;

a top housing that defines a top wall and a pair of side walls of the enclosure, the top wall having a convex curved portion that spans between the side walls, the convex curved portion having an angle that slopes downward from the rear wall towards the front wall, the top wall extending forward of a front surface of the front wall, the side walls proximate the top wall extending forward of the front surface of the front wall, and the side walls proximate the bottom wall extending forward of at least a rear surface of the front wall; and a main mount configured to secure the rear wall to a support structure with a standoff between the rear wall and the support structure, wherein the main mount has a downwardly sloping shoulder that slopes from a point more centrally located along a top edge of the rear wall outward toward an outer lateral edge of the rear wall.

16. The enclosure of claim 15, wherein the side walls proximate the bottom wall extend forward of only the rear surface of the front wall.

* * * * *